US009921041B1

(12) United States Patent
Hoang et al.

(10) Patent No.: US 9,921,041 B1
(45) Date of Patent: Mar. 20, 2018

(54) PRIMERLESS DIGITAL TIME-DELAY INITIATOR SYSTEM

(71) Applicant: The United States of America as Represented by the Department of the Navy, Washington, DC (US)

(72) Inventors: Thinh Hoang, Beltsville, MD (US); Khoa Nguyen, Waldorf, MD (US); Cuong Nguyen, Alexandria, VA (US); Troy Caruso, Alexandria, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 268 days.

(21) Appl. No.: 14/756,649

(22) Filed: Sep. 29, 2015

(51) Int. Cl.

| | |
|---|---|
| ***F23Q 7/00*** | (2006.01) |
| ***F42C 11/06*** | (2006.01) |
| ***F42C 11/02*** | (2006.01) |
| *F42D 1/055* | (2006.01) |
| *F42D 1/05* | (2006.01) |

(52) U.S. Cl.
CPC ..... *F42C 11/06* (2013.01); *F42C 11/02* (2013.01); *F42D 1/05* (2013.01); *F42D 1/055* (2013.01)

(58) Field of Classification Search
USPC ..... 361/249–252
See application file for complete search history.

(56) References Cited

U.S. PATENT DOCUMENTS

| | | | | |
|---|---|---|---|---|
| 5,133,257 | A | 7/1992 | Johnson | |
| 5,173,569 | A | 12/1992 | Pallanck et al. | |
| 5,377,592 | A | 1/1995 | Rode et al. | |
| 7,789,153 | B2 | 9/2010 | Prinz et al. | |
| 7,804,223 | B1 | 9/2010 | Teowee | |
| 8,002,026 | B2 | 8/2011 | Arrell, Jr. et al. | |
| 8,813,648 | B2 | 8/2014 | Remahl | |
| 2008/0110612 | A1* | 5/2008 | Prinz | E21B 43/1185 166/55.2 |
| 2011/0155012 | A1* | 6/2011 | Perez Cordova | F42B 3/122 102/215 |

* cited by examiner

*Primary Examiner* — Danny Nguyen
(74) *Attorney, Agent, or Firm* — Fredric J. Zimmerman

(57) ABSTRACT

An initiator system includes a firing pin and a piezoelectric-based energy harvester that generates and stores electric energy when impacted by the firing pin. The electric energy is independently available at a first output and second output of the energy harvester. An electronic time delay is coupled to the second output for generation of an electric trigger signal using the electric energy available at the second output. The electric trigger signal is generated at a selected period of time after the electric energy is available at the second output. An initiation-energy generator is coupled to the first output for the storage of electric energy available thereof. The initiation-energy generator is also coupled to the electronic time delay to receive the electric trigger signal, and uses stored electric energy to generate an initiation explosion when the electric trigger signal is received.

12 Claims, 2 Drawing Sheets

PRIMERLESS DIGITAL TIME-DELAY INITIATOR SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to initiator systems, and more particularly to an initiator system having a time delay and MEMS-type initiator powered by ballistically-energized piezoelectric materials.

BACKGROUND OF THE INVENTION

Detonation initiators that rely on the use of a column of a pressed-explosive for the initiator's time delay have a number of drawbacks. In general, pressed-explosive columns do not produce a precise time delay and typically can exhibit errors on the order of 25%. When used in aircraft systems such as aircrew escape systems, fire suppression systems, or ejection seat systems, initiators having a pressed-explosive time delay must be periodically replaced. Still further, pressed-explosive time delay initiators are expensive to manufacture.

SUMMARY OF THE INVENTION

Accordingly, it is an object of the present invention is to provide a time-delayed initiator system that avoids the drawbacks associated with pressed-explosive time delays.

Another object of the present invention is to provide a time-delayed initiator system providing a precise time delay over a relatively long useful life.

Yet another object of the present invention is to provide a time-delayed initiator system that is readily adapted to satisfy the form, fit, and function of existing pressed-explosive initiators.

Other objects and advantages of the present invention will become more obvious hereinafter in the specification and drawings.

In accordance with the present invention, an initiator system includes a firing pin and a piezoelectric-based energy harvester spaced-apart from the firing pin. The energy harvester generates and stores electric energy when impacted by the firing pin. The energy harvester has a first output and a second output where at least a portion of the electric energy is independently available at each of the first output and second output. The system also includes an electronic time delay coupled to the energy harvester's second output for the generation of an electric trigger signal using the electric energy available at the second output. The electric trigger signal is generated at a selected period of time after the electric energy is available at the second output. The system further includes an initiation-energy generator coupled to the energy harvester's first output for the storage of electric energy available thereat. The initiation-energy generator is also coupled to the electronic time delay to receive the electric trigger signal. The initiation-energy generator uses the electric energy stored thereby to generate an initiation explosion when the electric trigger signal is received.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
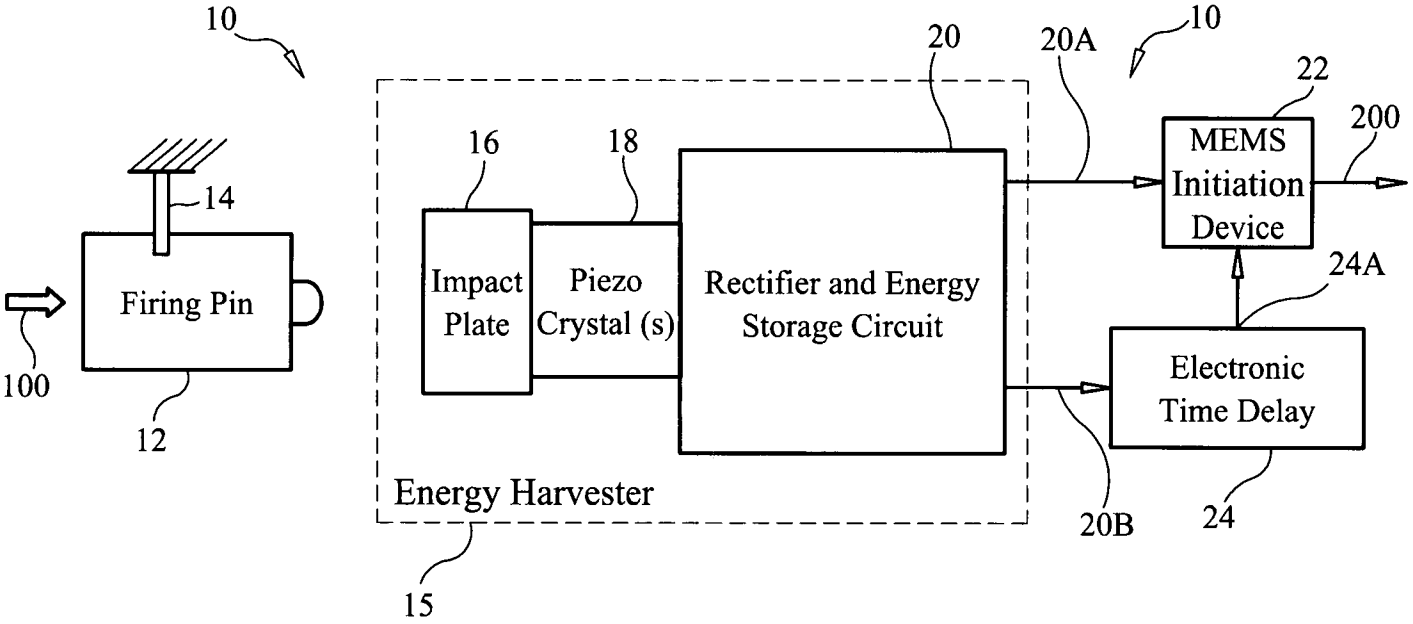
FIG. 1 is a schematic view of the functional elements of a piezoelectric-powered time-delayed initiator system in accordance with an exemplary embodiment of the present invention.

Referring now to the drawings and more particularly to FIG. 1, the functional elements of a piezoelectric powered time-delay initiator system in accordance with an exemplary embodiment of the present invention are shown with the system being referenced generally by numeral 10. Initiator system 10 may be configured and constructed in a variety of ways without departing from the scope of the present invention. By way of example, a cartridge-based initiator system will be described later herein.

Initiator system 10 includes a firing pin 12 that is driven to motion by a ballistic input 100. Depending on the type of device and application that will use initiator system 10, ballistic input 100 may be G-forces (e.g., acceleration generated during the firing or launching of a projectile), expanding-gas forces (e.g., from gas generator, primer charge, etc.), a spring force, and other forces. Accordingly, it is to be understood that the type of ballistic input 100 is not a limitation of the present invention. To prevent unwanted movement of firing pin 12 during normal handling, firing pin 12 may be restrained from movement by, for example, the use of a shear pin 14 that engages/restrains firing pin 12 during normal handling, but fails when ballistic input 100 is present.

When firing pin 12 is driven to movement by ballistic input 100, firing pin 12 travels until it strikes an impact plate 16 of an energy harvester 15. In general, energy harvester 15 generates and stores electric energy when firing pin 12 strikes impact plate 16. More specifically, impact plate 16 is a rigid plate (e.g., metal) having one face opposing firing pin 12 and its opposing face interfacing with piezoelectric crystals 18. The impact force created by firing pin 12 striking impact plate 16 resonates into piezoelectric crystals 18 that, in turn, generate AC electric energy owing to the piezoelectric effect. The generated AC electric energy is coupled to a rectifier and energy storage circuit 20 to convert the AC electric energy to DC electric energy and store the DC electric energy. In particular, circuit 20 provides the DC electric energy (or at least a portion thereof) at two independent outputs 20A and 20B. The electric energy available at output 20A is coupled to a MEMS initiation device 22, and the electric energy available at output 20B is coupled to an electronic time delay 24.

In general, MEMS initiation device 22 generates an initiation explosive output 200 when triggered into operation by electronic time delay 24. Explosive output 200 may be used to initiate a larger charge, propellant, etc., for the particular larger system (not shown) served by initiator system 10. The electric energy at output 20A is used to charge a firing capacitor of MEMS initiation device 22. The electric energy at output 20B is used to generate a time-delayed trigger signal used to trigger operation of MEMS initiation device 22. The time delay is selected to satisfy the charging time required by the firing capacitor of MEMS initiation device 22.

Figure 2:
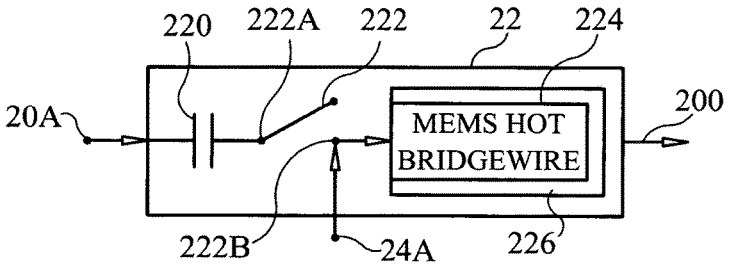
FIG. 2 is an isolated schematic view of a MEMS initiation device in accordance with an exemplary embodiment of the present invention.

Referring additionally now to FIG. 2, an isolated schematic view of an exemplary embodiment of MEMS initiation device 22 is illustrated. A firing capacitor 220 has one side thereof coupled to output 20A. The other side of firing capacitor 220 is coupled to one side 222A of a switch 222 that is biased to the open position when no electric energy is applied to the other side 222B of switch 222. However, when electric energy is applied to side 222B, switch 222 closes. Coupled to side 222B of switch 22 is a MEMS hot bridgewire 224. Disposed or deposited on hot bridgewire 224 is a primer charge material 226 (e.g., lead styphnate, lead azide, potassium 5,7-dinitro-[2,1,3]-benzoxadiazol-4-olate 3-oxide or KDPN as it is known, etc.).

Electronic time delay 24 is any circuit that will generate a time-delayed electric trigger signal using the electric energy at output 20B. The particular design of time delay 24 may be varied without departing from the scope of the present invention. By being electronically generated, the time-delayed trigger signal may be precisely generated once electric energy is available at output 20B. The time-delayed electric trigger signal is indicated by reference numeral 24A.

In operation, the striking of impact plate 16 by firing pin 12 sets off a precise chain of events. The electric energy generated by piezoelectric crystals 18 and made available at independent outputs 20A and 20B sets off parallel operations in device 22 and delay 24. As a result, the electric trigger signal 24A closes switch 222 so that firing capacitor 220 discharges across hot bridgewire 224 to ignite primer charge material 226 and thereby generate explosive output 200.

Figure 3:
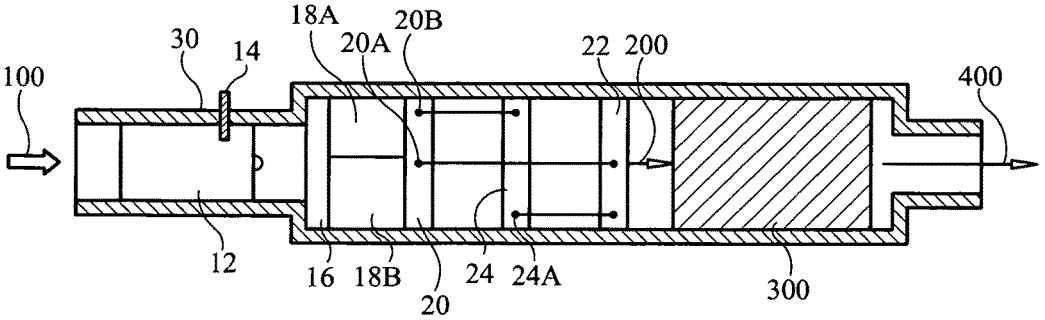
FIG. 3 is part cross-sectional, part schematic view of a cartridge-based time-delayed initiator system in accordance with an exemplary embodiment of the present invention.

As mentioned above, initiator system 10 may be configured/constructed in a variety of ways. By way of example, FIG. 3 illustrates a cartridge-based exemplary embodiment of the present invention where an open-ended cartridge housing 30 has the above-described elements mounted therein. Ballistic input 100 is applied through one open end of housing 30 to act on firing pin 12 and drive it towards impact plate 16 as described above. In this exemplary embodiment, two piezoelectric crystals 18A and 18B are used such that the piezoelectric effect evidenced by crystal 18A is associated with output 20A, while the piezoelectric effect of crystal 18B is associated with output 20B. Each of circuit 20, device 22, and delay 24, may be constructed on individual printed circuit boards and stacked within housing 30. The explosive output 200 may be used to ignite a primer/propellant 300 in housing 30. Hot gases 400 associated with the burning of primer/propellant 300 exit an opposing end of housing 30.

Although the invention has been described relative to a specific exemplary embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. An initiator system, comprising:

a firing pin;

a piezoelectric-based energy harvester being spaced-apart from said firing pin for generating and storing electric energy when being impacted by said firing pin, said energy harvester includes a first output and a second output, wherein at least a portion of said electric energy is independently available at each of said first output and said second output;

an electronic time delay being coupled to said second output for generating an electric trigger signal using said portion of said electric energy available at said second output, said electric trigger signal is generated at a selected period of time after said portion of said electric energy is available at said second output; and an initiation-energy generator being coupled to said first output for storing said portion of said electric energy available thereat, said initiation-energy generator coupled to said electronic time delay to receive said electric trigger signal, said initiation-energy generator uses said portion of said electric energy stored thereby to generate an initiation explosion when said electric trigger signal is received.

2. The initiation system as in claim 1, wherein said energy harvester comprises a rigid plate, piezoelectric crystals and an electric energy storage circuit, wherein the rigid plate includes a first face spaced-apart from said firing pin, wherein the rigid plate includes a second face, wherein the piezoelectric crystals is coupled to said second face, and wherein the electric energy storage circuit is coupled to said piezoelectric crystals.

3. The initiation system as in claim 2, wherein said piezoelectric crystals comprise a first piezoelectric crystal associated with said first output and a second piezoelectric crystal associated with said second output.

4. The initiator system as in claim 1, wherein said initiation-energy generator includes a capacitor, a hot bridgewire, and a primer charge, wherein the capacitor includes a first side coupled to said first output and a second side, wherein the hot bridgewire is coupled to said second side of said capacitor, wherein the primer charge is deposited on at least a portion of said hot bridgewire, and wherein said capacitor discharges across said hot bridgewire when said electric trigger signal is received by said initiation-energy generator.

5. An initiator system, comprising:

a firing pin;

a piezoelectric-based energy harvester being space-apart from said firing pin for generating and storing electric energy when being impacted by said firing pin, wherein said energy harvester includes a first output and a second output, and wherein at least a portion of said electric energy is independently available at each of said first output and said second output;

an initiation-energy generator being coupled to said first output for storing said portion of said electric energy available thereat, wherein said initiation-energy generator includes a switch biased to be open when no electric energy is applied thereto, and wherein said initiation-energy generator generates an initiation explosion when said switch is closed; and an electronic time delay being coupled to said second output and to said switch for generating an electric trigger signal using said portion of said electric energy available at said second output, wherein said electric trigger signal is generated at a selected period of time after said portion of said electric energy is available at said second output, and wherein said electric trigger signal is applied to said switch where said switch closes.

6. The initiation system as in claim 5, wherein said energy harvester comprises a rigid plate, a piezoelectric crystals and an electric energy storage circuit, wherein said a rigid plate includes a first face spaced-apart from said firing pin, wherein said rigid plate includes a second face, wherein said piezoelectric crystals coupled to said second face, and wherein said electric energy storage circuit coupled to said piezoelectric crystals.

7. The initiation system as in claim 6, wherein said piezoelectric crystals comprise a first piezoelectric crystal associated with said first output and a second piezoelectric crystal associated with said second output.

8. The initiator system as in claim 5, wherein said initiation-energy generator comprises a capacitor, a hot bridgewire, and a primer charge, wherein said capacitor includes a first side coupled to said first output, wherein said capacitor includes a second side, wherein said primer charge deposited on at least a portion of said hot bridgewire, and wherein said switch coupled between said second side of said capacitor and said hot bridgewire.

9. An initiator system, comprising:

a housing;

a firing pin being slidably disposed in said housing;

a piezoelectric-based energy harvester being spaced-apart from said firing pin for generating and storing electric energy when being impacted by said firing pin sliding within said housing, wherein said energy harvester includes a first output and a second output, and wherein at least a portion of said electric energy is independently available at each of said first output and said second output;

an initiation-energy generator being mounted in said housing and being coupled to said first output for storing said portion of said electric energy available thereat, wherein said initiation-energy generator includes a switch biased to be open when no electric energy is applied thereto, and wherein said initiation-energy generator uses said portion of said electric energy stored thereby to generate an initiation explosion when said switch is closed; and an electronic time delay being mounted in said housing and being coupled to said second output and to said switch for generating an electric trigger signal using said portion of said electric energy available at said second output, wherein said electric trigger signal is generated at a selected period of time after said portion of said electric energy is available at said second output, and wherein said electric trigger signal is applied to said switch wherein said switch closes.

10. The initiation system as in claim 9, wherein said energy harvester comprises a rigid plate, piezoelectric crystals and an electric energy storage circuit, wherein the rigid plate includes a first face spaced-apart from said firing pin, wherein the rigid plate includes a second face, wherein the piezoelectric crystals is coupled to said second face, and wherein the electric energy storage circuit is coupled to said piezoelectric crystals.

11. The initiation system as in claim 10, wherein said piezoelectric crystals comprise a first piezoelectric crystal associated with said first output and a second piezoelectric crystal associated with said second output.

12. The initiator system as in claim 10, wherein said initiation-energy generator comprises a capacitor, a hot bridgewire and a primer charge, wherein the capacitor includes a first side coupled to said first output, wherein said capacitor includes a second side, wherein the primer charge is deposited on at least a portion of said hot bridgewire, and wherein said switch is coupled between said second side of said capacitor and said hot bridgewire.

* * * * *